US008768195B2

(12) United States Patent
Shirata

(10) Patent No.: US 8,768,195 B2
(45) Date of Patent: Jul. 1, 2014

(54) IMAGE PROCESSING APPARATUS AND IMAGE PROCESSING METHOD

(75) Inventor: Yasunobu Shirata, Ohta-ku (JP)

(73) Assignee: Ricoh Company, Limited, Tokyo (JP)

( * ) Notice: Subject to any disclaimer, the term of this patent is extended or adjusted under 35 U.S.C. 154(b) by 349 days.

(21) Appl. No.: 13/137,015

(22) Filed: Jul. 15, 2011

(65) Prior Publication Data

US 2012/0020694 A1 Jan. 26, 2012

(30) Foreign Application Priority Data

Jul. 23, 2010 (JP) ..... 2010-166057
May 23, 2011 (JP) ..... 2011-114706

(51) Int. Cl.
*G03G 15/00* (2006.01)

(52) U.S. Cl.
USPC ..... 399/81

(58) Field of Classification Search
USPC ..... 399/81, 75
See application file for complete search history.

(56) References Cited

U.S. PATENT DOCUMENTS

2002/0071689 A1* 6/2002 Miyamoto ..... 399/53
2009/0295824 A1 12/2009 Shirata

FOREIGN PATENT DOCUMENTS

JP 2002123055 A 4/2002
JP 2003094732 A 4/2003
JP 3689662 B2 6/2005
JP 2008153725 A 7/2008

OTHER PUBLICATIONS

Abstract of Japanese patent publication JP 2003-094757, Pub date Apr. 3, 2003.

* cited by examiner

*Primary Examiner* — Walter L Lindsay, Jr.
*Assistant Examiner* — Rodney Bonnette
(74) *Attorney, Agent, or Firm* — Harness, Dickey & Pierce, P.L.C.

(57) ABSTRACT

An image processing apparatus is capable of performing a plurality of toner-saving processes each reducing an amount of toner consumed to form an image. The apparatus includes a selecting unit that allows a user to select one toner saving process from the plurality of toner saving processes; a toner saving unit that performs the one toner saving process selected through the selecting unit; and a display unit that provides, when the one toner saving process is a predetermined toner saving process that yields a printed output whose print quality is not easily presumed by the user, a preview display representing the print quality of the printed output to be yielded by the one toner saving process.

7 Claims, 8 Drawing Sheets

FIG.6

| PROCESS NO. | PROCESSING DETAILS | PRINT PREVIEW |
|---|---|---|
| [1] | REDUCE TONER DENSITY AND COLOR SATURATION | NO |
| [2] | ADJUST HUE FOR REPRODUCTION WITH SINGLE-COLOR TONER | NO |
| [3] | ADJUST HUE WHILE KEEPING COLOR DIFFERENCE AT PREDETERMINED LEVEL | YES |
| [4] | CONVERT YELLOW HUE TO BLACK MONOCHROME | NO |
| [5] | CONVERT HUE OF LOW-BRIGHTNESS OBJECT TO BLACK MONOCHROME | NO |
| [6] | SET TONER DENSITY OF CHARACTER HIGH AT EDGE PORTION AND LOW AT INSIDE PORTION | YES |

IMAGE PROCESSING APPARATUS AND IMAGE PROCESSING METHOD

CROSS-REFERENCE TO RELATED APPLICATIONS

The present application claims priority to and incorporates by reference the entire contents of Japanese Patent Application No. 2010-166057 filed in Japan on Jul. 23, 2010 and Japanese Patent Application No. 2011-114706 filed in Japan on May 23, 2011.

BACKGROUND OF THE INVENTION

1. Field of the Invention

The present invention relates to image processing apparatuses and image processing methods for providing a means to a preview display for evaluating quality of an output image.

2. Description of the Related Art

An image processing apparatus, such as a printer, that forms an image on a recording sheet with colorant, such as toner, is usually provided with a toner-saving process that reduces toner consumption. Examples of techniques to reduce toner consumption include a technique to reduce an amount of toner to be used by reducing toner density by using a gamma conversion table and a technique to reduce an amount of toner consumption by presetting a narrow range of color-reproduction area for a toner saving purpose to thereby output an image with a low color saturation.

Some printer drivers have a preview function and a printer-setting function that can be used with a display, so that a user can judge, prior to printing, quality of a printed output that the user may obtain with printing conditions set on a setting screen of the display. (See, for instance, Japanese Patent Application Laid-open No. 2003-094757).

For a toner-saving processing that yields a printed output whose print quality is easily presumed by a user, a default setting is configured by the user not to provide a print preview, so that a printed output is produced without a print preview. However, there is a different type of a toner-saving process with which a user cannot easily presume quality of an output image and a hue adjustment is necessary in carrying out printing.

When, being set as a default printing mode, the user designates the toner-saving process with which print quality is not easily presumed by the user, the quality of a printed image can be different from that being presumed by the user because a to-be-printed image is not evaluated in a print preview. In such a case, the user has to print out an image again by designating a different toner-saving process to undesirably lower production efficiency.

Even when the toner-saving process, for which a default setting is to show a print preview, is designated, because a preview is shown on the display irrespective of whether or not the user can easily presume the quality of a printed image, the user has to evaluate the quality, when output, of a printed image, resulting in lowering of the production efficiency. It is more efficient to display a print preview when the user cannot easily presume the quality of a printed image, and accordingly, it is desirable that a print preview is automatically displayed to enable the user to evaluate the print quality prior to printing.

SUMMARY OF THE INVENTION

It is an object of the present invention to at least partially solve the problems in the conventional technology.

According to an aspect of the present invention, there is provided an image processing apparatus with a plurality of toner-saving processes each reducing an amount of toner consumed to form an image. The image processing apparatus includes a selecting unit that allows a user to select one toner saving process from the plurality of toner saving processes; a toner saving unit that performs the one toner saving process selected through the selecting unit; and a display unit that provides, when the one toner saving process is a predetermined toner saving process that yields a printed output whose print quality is not easily presumed by the user, a preview display representing the print quality of the printed output to be yielded by the one toner saving process.

According to another aspect of the present invention, there is provided an image processing method that includes a plurality of toner saving processes each reducing an amount of toner consumed to form an image. The image processing method includes allowing a user to select one toner saving process from the plurality of toner saving processes; performing the one toner saving process selected at the selecting; and providing, when the one toner saving process is a predetermined toner saving process that yields a printed output whose print quality is not easily presumed by the user, a preview display representing the print quality of the printed output to be yielded by the one toner saving process.

According to still another aspect of the present invention, there is provided a computer program product including a non-transitory computer-readable medium having computer-readable program codes recorded in the medium. The program codes, when executed, cause a computer to perform an image processing including a plurality of toner saving processes each reducing an amount of toner consumed to form an image. The image processing includes allowing a user to select one toner saving process from the plurality of toner saving processes; performing the one toner saving process selected at the selecting; and providing, when the one toner saving process is a predetermined toner saving process that yields a printed output whose print quality is not easily presumed by the user, a preview display representing the print quality of the printed output to be yielded by the one toner saving process.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 6 is a table presenting types of and processing details about toner-saving processing according to the embodiment;

DETAILED DESCRIPTION OF THE PREFERRED EMBODIMENTS

Exemplary embodiments of the present invention are described below in detail with reference to the accompanying drawings. According to an aspect of the present invention, a toner-saving process is performed such that, when one toner-saving process selected by a user from a plurality of toner-saving processes yields an output image whose print quality is not easily presumed by the user, a print preview is automatically displayed so that a printed output is produced after print quality has been checked by the user.

Figure 1:
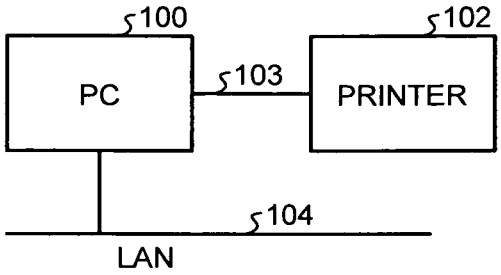
FIG. 1 is a block diagram illustrating the configuration of a printing system including an image forming apparatus according to an embodiment of the present invention.

FIG. 1 is a block diagram illustrating the configuration of a printing system including an image forming apparatus according to an embodiment of the present invention. In the present embodiment, the image forming apparatus is implemented in a laser printer form. As illustrated in FIG. 1, the printing system includes a personal computer (PC) 100, which is an image-output control apparatus that creates and processes a printing document, and a printer 102 that produces a printed output of the printing document. The printer 102 is directly connected to the PC 100 via a universal serial bus (USB) cable 103. The PC 100 is connected to a local area network (LAN) 104 and capable of carrying out data communications by electronic mails and the like via the LAN 104.

Figure 2:
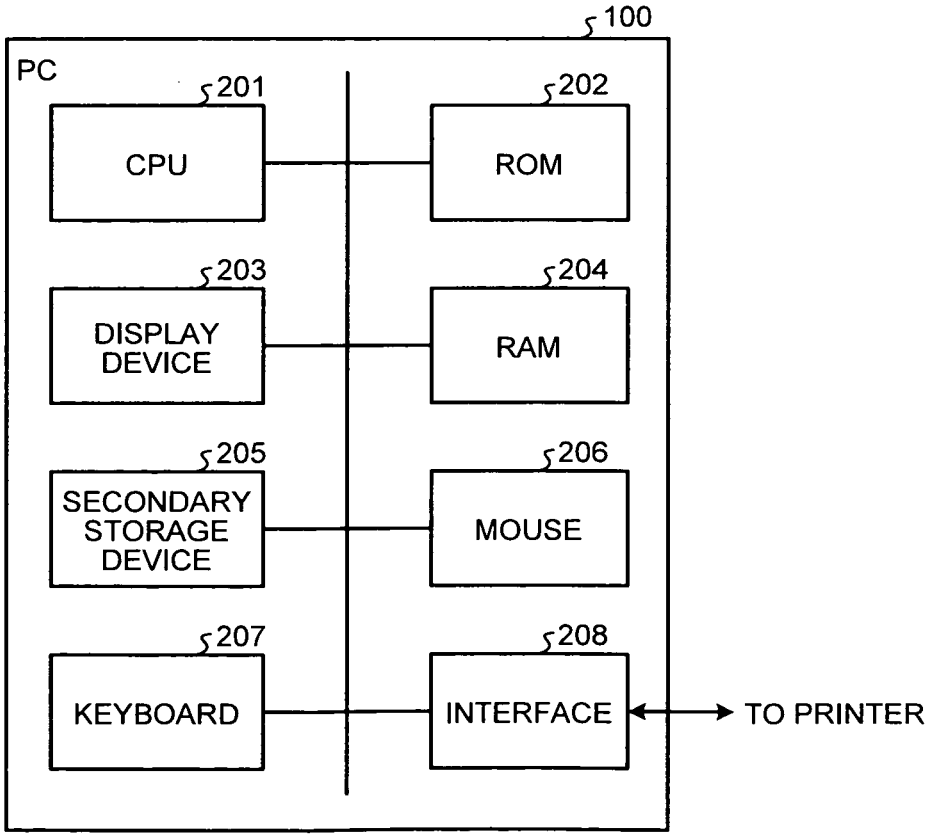
FIG. 2 is a block diagram illustrating the configuration of a personal computer (PC) in FIG. 1.

FIG. 2 is a block diagram illustrating the configuration of the PC 100 illustrated in FIG. 1. Referring to FIG. 2, the PC 100 includes a central processing unit (CPU) 201 that controls the overall PC 100, a read only memory (ROM) 202, a display device 203 such as a display, a random access memory (RAM) 204, and a user interface such as a keyboard 207 and a mouse 206. The ROM 202 stores data and programs to be executed by the CPU 201. The RAM 204 stores application programs and an operating system (OS) loaded from a secondary storage device 205 and to be executed by the CPU 201 and provides a working area for temporarily storing various data pieces when control processes are performed by the CPU 201.

The applications programs and the OS are installed on the secondary storage device 205, which is a hard disk drive or the like. The OS and the application programs are loaded into the RAM 204 and executed as necessary. An interface 208 includes a serial bus interface, such as a USB or IEEE1394 interface, for connecting to a printer, a digital camera, and the like, and a network interface for connecting to a network, such as the Internet or a LAN.

The display device 203, which is a cathode ray tube (CRT) or the like, displays a screen for use in operating the PC 100 and also displays a result of execution of an application program. The keyboard 207 receives various designations to the PC 100 input by various key operations. The mouse 206 is used to indicate a desired point on the display device 203.

Printing document information can be stored in the PC 100 in various ways. For instance, printing document information may be created by an application program started on the PC 100 and then stored in the secondary storage device 205; in another instance, printing document information stored in a compact disk read-only memory (CD-ROM) may be read out from the CD-ROM and stored in the PC 100; in still another instance, printing document information may be rebuilt from information received via the LAN 104 in a form of an electronic mail or the like and stored in the PC 100.

Figure 3:
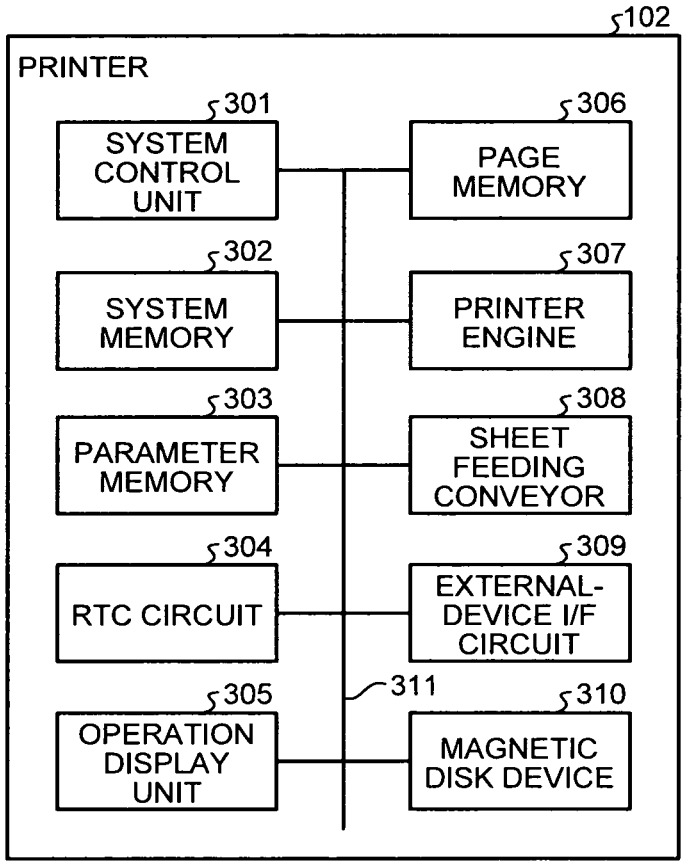
FIG. 3 is a block diagram illustrating the configuration of the printer in FIG. 1.

FIG. 3 is a block diagram illustrating the configuration of the printer 102 illustrated in FIG. 1. As illustrated in FIG. 3, the printer 102 includes a system control unit 301 that performs various control processes including an image forming process. The system control unit 301 is connected to system memory 302, parameter memory 303, a real-time clock (RTC) circuit 304, an operation display unit 305, a page memory 306, a printer engine 307, a sheet-feeding conveyor 308, an external-device interface (I/F) circuit 309, and a magnetic disk device 310 via an internal bus 311 to exchange data.

In the present embodiment, the printer 102 is a laser printer. The printer engine 307 performs an electrophotographic process to form a color image on a recording sheet. Hence, the printer engine 307 is a tandem engine that includes four photosensitive elements to form color images of cyan (C), magenta (M), yellow (Y), and black (Bk), and optical scanning devices that write CMYK-image data of each color, for instance.

The system memory 302 stores control processing programs to be executed by the system control unit 301 and various data pieces necessary for executing the control processing programs and also provides a working area for the system control unit 301. The parameter memory 303 stores various information pieces characteristic to the printer 102.

The RTC circuit 304 outputs current time data. The operation display unit 305 includes various operation keys and display device for use in operating the printer 102. The page memory 306 stores image data (print-drawing image) to be printed. The printer engine 307 outputs the image data stored in the page memory 306 onto a recording sheet.

The sheet-feeding conveyor 308 picks up a recording sheet held in a paper cassette or the like and delivers the recording sheet to an image recording position of the printer engine 307, and discharges the sheet onto a discharge tray at a final stage of a process sequence.

The external-device I/F circuit 309, which is connected to the PC 100 via the USB cable 103, receives print job data and the like and transmits data representing a print result and the like to the PC 100. The magnetic disk device 310 stores various printing document information pieces, information files and the like.

Functions of the system control unit 301 of the printer 102 are described below. In a page printer, such as a laser printer, page description language (PDL) is typically used in describing image data to be printed.

A page printer typically directly receives image data described in PDL, interprets graphics drawing commands contained in the image data described in PDL, generates a to-be-printed image that includes drawing objects obtained by the interpretation, and stores the to-be-printed image in the page memory 306.

Figure 4:
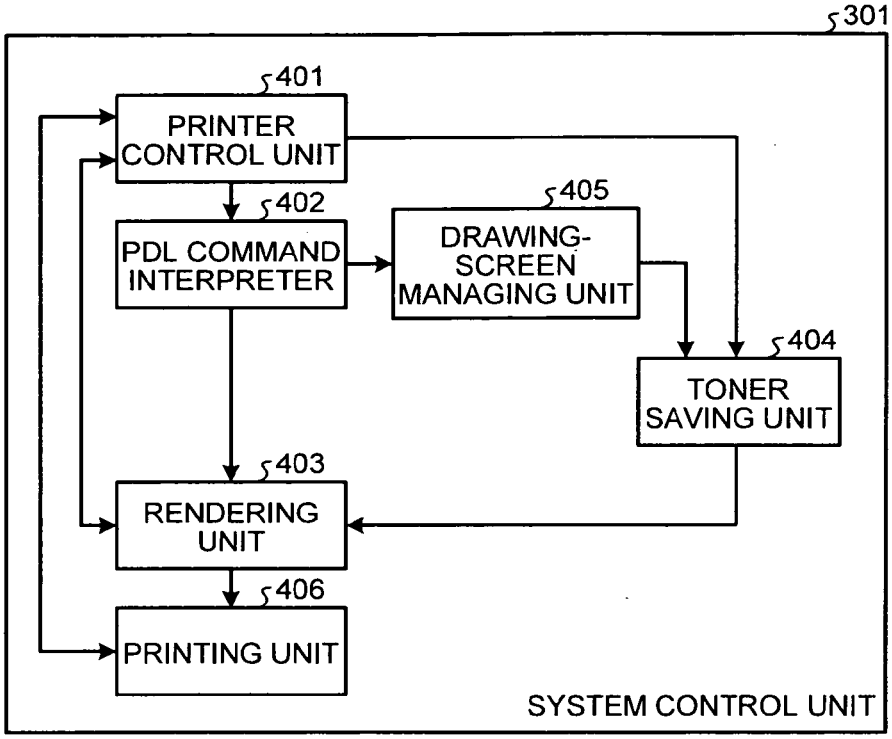
FIG. 4 is a block diagram illustrating the configuration of a system control unit in FIG. 3.

FIG. 4 is a block diagram illustrating the configuration of the system control unit 301 illustrated in FIG. 3. As illustrated in FIG. 4, the system control unit 301 includes a printer control unit 401, a PDL command interpreter 402, a rendering unit 403, a toner saving unit 404, a drawing-screen managing unit 405, and a printing unit 406.

Upon receiving printing data, the printer control unit 401 transfers the printing data to the PDL command interpreter 402 and, in a situation where a toner saving function is activated, sends a notification to the toner saving unit 404.

In a situation where a predetermined specific toner saving process is to be performed, the printer control unit 401 transmits the print-drawing image unfolded in the page memory 306 to the PC 100 via the external-device I/F circuit 309.

The PDL command interpreter 402 sequentially interprets the graphics drawing commands, which are PDL data, contained in the printing data input to the PDL command interpreter 402 via the external-device I/F circuit 309 and transmits a result of interpretation (a type (character/image) of a drawing object, a drawing position, a drawing attribute, and the like) to the rendering unit 403 and the drawing-screen managing unit 405.

The drawing-screen managing unit 405 analyzes the result of interpretation (the type (character/image/graphics) of the drawing object, the drawing position, the drawing attribute, and the like) input from the PDL command interpreter 402 and transmits a result of analysis to the toner saving unit 404.

When the toner saving unit 404 has received a designation not to perform the toner saving function from the printer control unit 401, the toner saving unit 404 determines color conversion coefficients for performing normal color conversion and transmits the color conversion coefficients to the rendering unit 403. In contrast, when the toner saving unit 404 has received a designation to perform the toner saving function from the printer control unit 401, the toner saving unit 404 determines, for each drawing object input from the drawing-screen managing unit 405, color conversion coefficients for performing a toner saving process and transmits a result of the determination to the rendering unit 403.

A plurality of toner saving processes are provided. Notification about a toner saving process selected by a user from the toner saving processes is sent from the printer control unit 401 to the toner saving unit 404. When, for instance, as will be described later with reference to FIG. 6, it is assumed that six toner-saving processes, to which numbers [1] to [6] are assigned, are provided, the printer control unit 401 sends a notification of the number assigned to the toner-saving process to be performed. The toner-saving processes will be described in details later.

The rendering unit 403 renders a print-drawing image consisting of three types (character/image/graphics) of drawing objects according to the type of the drawing object, the drawing position, the drawing attribute, and the like of each object input from the PDL command interpreter 402, and unfolds the print-drawing image in the page memory 306. The rendering unit 403 also performs color conversion on the input image according to the color conversion coefficients determined at the toner saving unit 404. The rendering unit 403 also transmits, after completion of rendering, a notification to the printer control unit 401 to inform that the rendering process by the rendering unit 403 is completed.

Upon receiving a designation from the printer control unit 401 for producing a printout of the print-drawing image unfolded by the rendering unit 403 in the page memory 306, the printing unit 406 performs printing by using the printer engine 307, thereby printing out the image on a recording sheet.

Figure 5:
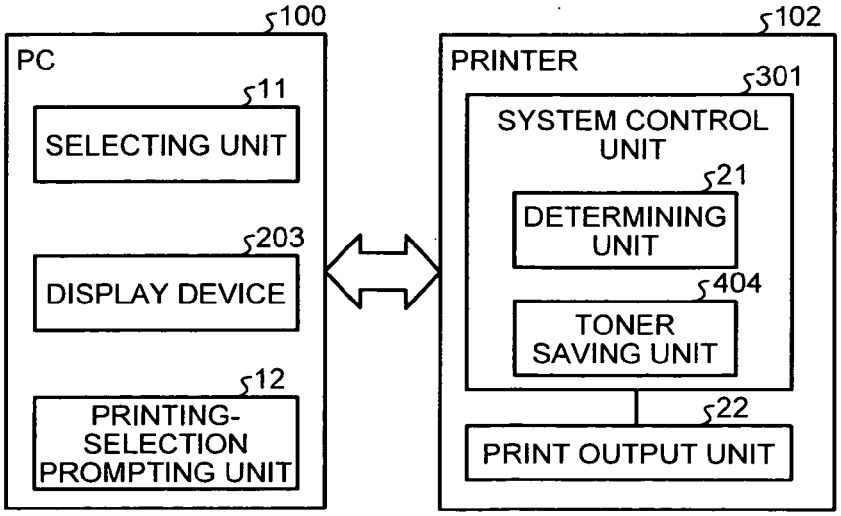
FIG. 5 is a block diagram illustrating a functional configuration of the printing system including the image forming apparatus according to the embodiment.

FIG. 5 is a block diagram illustrating a functional configuration of the printing system including the image forming apparatus according to the embodiment. Referring to FIG. 5, the image processing apparatus of the printing system is PC 100, which includes a selecting unit 11 for selecting one toner-saving process from the plurality of (in the present embodiment, six) toner-saving processes input from the printer control unit 401, the display device 203, a printing-selection prompting unit 12 for prompting a user to select whether or not printing in a preview-displayed print quality is to be performed, a determining unit 21 that determines whether or not the toner-saving process selected by the selecting unit 11 is a toner-saving process that yields an output whose print quality is not easily presumed by a user, a toner saving unit 404 that performs the selected toner-saving process, and a print output unit 22 that prints out an image having undergone the toner-saving process on a recording sheet according to a designation received from the printing-selection prompting unit 12.

The selecting unit 11 is implemented with the mouse 206 and the keyboard 207 and configured such that, when a toner-saving process is selected by a user on the display device 203, the plurality of toner-saving processes are displayed on the screen so that the user can select a desired one of the toner-saving processes. The determining unit 21, which is included in the system control unit 301, determines whether or not the selected toner-saving process is a toner-saving process that yields an output whose print quality is not easily presumed by the user. When a print preview is to be provided, a print-drawing image input from the printer 102 is displayed on the display device 203, causing a user to determine whether or not the print-drawing image is to be printed on a recording sheet with a preview-displayed print quality. Thereafter, a designation to perform printing is input with the mouse 206 or the keyboard 207. The print output unit 22 includes the printer engine 307 and the sheet-feeding conveyor 308.

FIG. 6 is a table presenting types of and processing details about the toner-saving processes according to the embodiment. As illustrated in FIG. 6, in the present embodiment, the six toner-saving processes numbered [1] to [6] are provided. The toner-saving process [1] simply decreases image density and color saturation. The toner-saving process [2] adjusts hue of an image to cause the image to be reproduced with any one of the four single-color toners. The toner-saving process [3] adjusts, if an image contains a plurality of objects, hue such that color differences between hue-adjusted objects are kept at a level equal to or larger than a predetermined value. The toner-saving process [4] converts hue of a character object to black without performing adjustment to yellow (Y) hue. The toner-saving process [5] causes an object to be reproduced in black monochrome, depending on brightness of the object. The toner-saving process [6] extracts edges of a character and prints the character such that a toner density is lower at an inside portion of the character than at edge portion of the character. Note that print preview is to be provided in processes indicated by "YES" in FIG. 6, whereas print preview is not to be provided in processes indicated by "NO".

Figure 7:
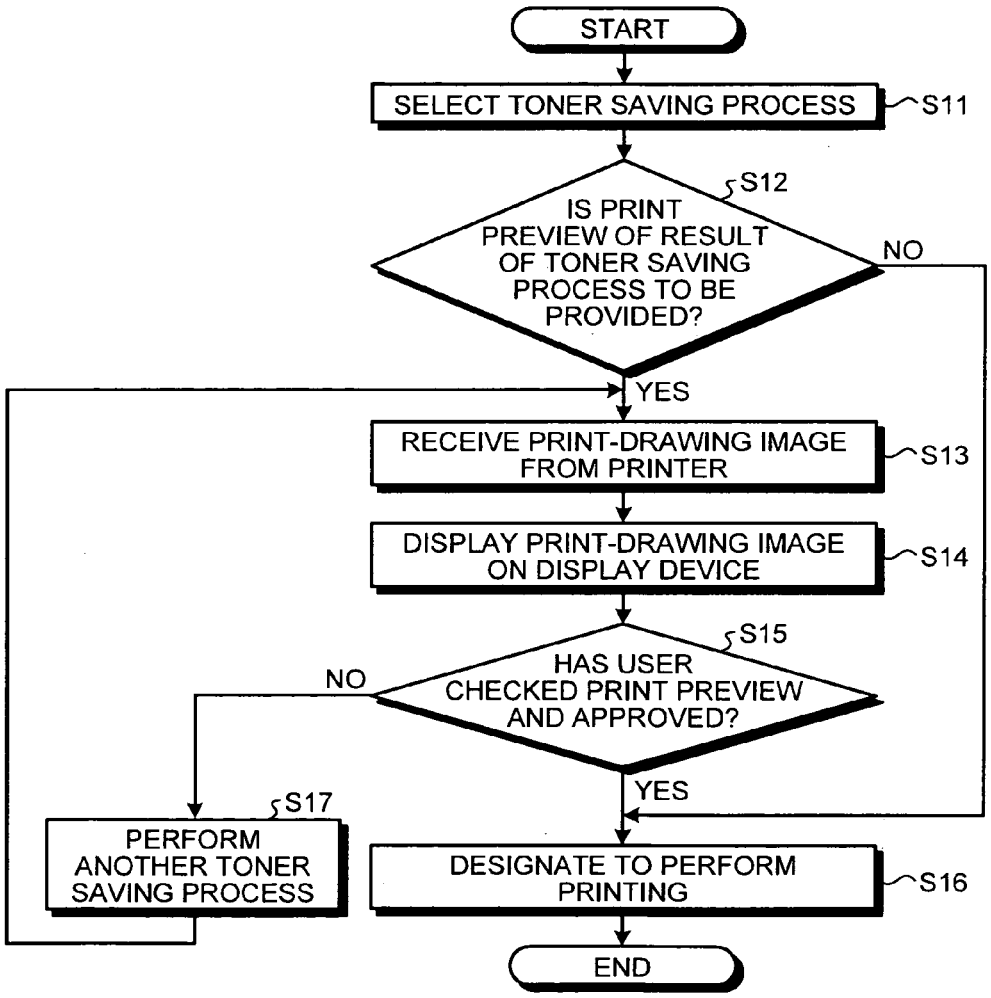
FIG. 7 is a flowchart illustrating a process sequence from a toner-saving processing to a print display according to the embodiment.

FIG. 7 is a flowchart illustrating a process sequence from a toner-saving process to a print display according to the embodiment. When receiving a designation of a toner saving process by a user, the display device 203 displays the plurality of toner-saving processes. The user selects therefrom a toner-saving process to be performed (step S11).

Subsequently, the printer control unit 401 determines whether or not to provide a print preview of a result of the selected toner-saving process (step S12). If it is determined that the print preview of the result of the toner-saving process is to be provided (YES at step S12), the process proceeds to step S13. If it is determined that the print preview of the result of the toner-saving process is not to be provided (NO at step S12), the process proceeds to step S16.

The printer control unit 401 determines whether or not to provide the print preview according to the process number assigned to the toner-saving process described above. For example, when six toner-saving processes are provided, the printer control unit 401 may have a table showing correspondence between the process numbers of the toner-saving processes and propriety of providing print previews, as illustrated in FIG. 6. Accordingly, the table is to be configured such that a print preview is to be provided for a toner-saving process that produces an output whose image quality is not easily presumed by the user.

At step S13, the PC 100 receives a print-drawing image from the printer 102, and the process proceeds to step S14. A specific process is realized as follows. As described above with reference to FIG. 4, when the printer control unit 401 receives a notification about the completion of rendering of a print-drawing image from the rendering unit 403, the print-drawing image having undergone the toner-saving process, for which a print preview is to be provided, is transmitted to the PC 100.

At step S14, the printer control unit 401 causes the display device 203 to display the print-drawing image (the image having undergone the toner-saving process) input from the printer 102. At step S15, the printer control unit 401 prompts a user to designate whether or not to perform printing in the preview-displayed print quality by inputting the designation with the keyboard 207 or the mouse 206. If a result of the determination made at step S15 is YES, the process proceeds to step S16. On the contrary, if the result of the determination is NO, another toner-saving process is performed by the printer 102 (step S17), and the printer control unit 401 performs processing pertaining to step S13 and subsequent steps again. At step S16, the user designates, via the PC 100, the printer 102 to perform printing, and the process sequence ends.

In the present embodiment, when it is determined that a print preview is to be provided for a toner-saving process to be performed, the print preview is automatically provided, causing a user to check the print preview before a designation to perform printing is transmitted to the printer 102. This prevents an undesirable printing, in a toner saving process, of an output that differs from a print quality of the user's intention. Each of the examples of the toner-saving processes will be described below.

Toner Saving Process [1]

It is described how the toner saving unit 404 performs the toner saving process [1]. As described above, the toner-saving process configures settings by decreasing a print density in the toner-saving process than in a normal printing process by using a gamma conversion table so that an image is formed with a low toner density. This toner-saving process can be performed by using a technique of reducing an amount of toner to be used in printing or a technique of reducing an amount of toner to be used by restricting a color reproduction area for toner saving, thereby outputting an image with reduced color saturation.

This toner-saving process is a toner-saving process that yields an output whose print quality is easily presumed by a user because the toner-saving process only decreases the toner density and the color saturation.

Toner-Saving Process [2]

The toner-saving process [2], which is an example of a toner-saving process that yields an output whose print quality is not easily presumed by a user, adjusts hue of an image, thereby causing the image to be reproduced with any one of the four single-color toners. This process for reducing an amount of toner to be used is described below.

It is assumed that color information pertaining to input image data is basically composed of red, green, and blue (RGB) data. It is assumed that, when necessary for a unit involved in processing the image data, the unit converts RGB values to International Commission on Illumination (CIE) L*a*b* values or L*C*H* values (which are obtained by converting coordinates (a*, b*) on the a*b* plane in the CIE L*a*b* color system to representation (C*, H*) in the polar coordinate system) to perform the processing.

Figure 8:
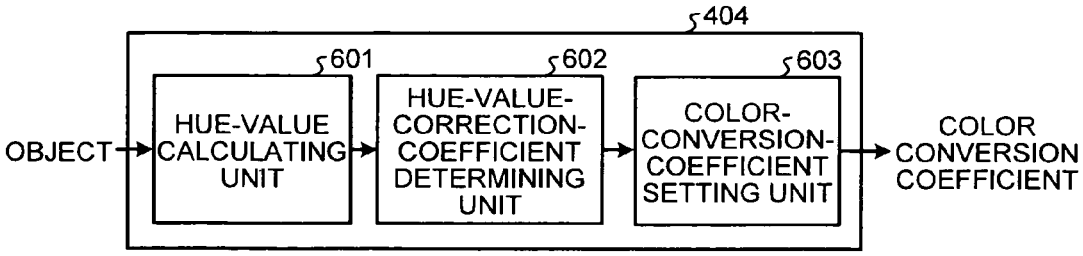
FIG. 8 is a block diagram illustrating the configuration of a toner saving processing unit.

FIG. 8 is a block diagram illustrating the configuration of the toner saving unit 404. As illustrated in FIG. 8, the toner saving unit 404 includes a hue-value calculating unit 601 that calculates a hue value of an object from pixel values (RGB values) of the object input from the drawing-screen managing unit 405, a hue-value-correction-coefficient determining unit 602 that determines a hue correction amount for toner saving to determine a hue correction coefficient, and a color-conversion-coefficient setting unit 603 that sets color conversion coefficients by taking account of hue correction based on the hue correction coefficients.

Figure 9:
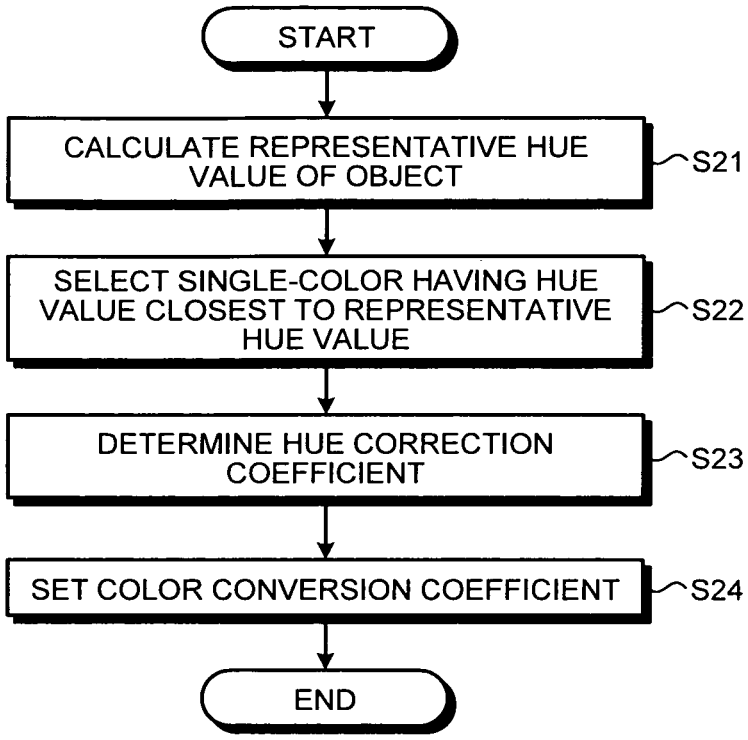
FIG. 9 is a flowchart illustrating an example of a process sequence for adjusting hue of an image.

FIG. 9 is a flowchart illustrating an example of a process sequence for adjusting hue of an image. The toner saving unit 404 calculates a hue value of a drawing object input from the drawing-screen managing unit 405 and performs hue correction to hue to be reproduced with a single-color toner having hue closest to the obtained hue value. Note that the hue to be reproduced with the single-color toner is any one hue of cyan, magenta, and yellow.

At step S21, the hue-value calculating unit 601 calculates a representative hue value of an input object based on pixel values assigned to the object. More specifically, the hue-value calculating unit 601 calculates average RGB values of pixels belonging to the object first, and performs conversion to a hue value H*, serving as a representative hue value, in the CIE L*C*H* color space, thereby obtaining a representative hue value H*_ave.

Subsequently, at step S22, the hue-value calculating unit 601 compares the obtained representative hue value H*_ave with each hue value of cyan, magenta, and yellow (H*_C, H*_M, and H*_Y), thereby selecting a hue value closest to the representative hue value H*_ave.

Subsequently, at step S23, the hue-value-correction-coefficient determining unit 602 determines a hue correction coefficient for use in hue conversion to the selected hue value. For example, if the representative hue value is closest to H*_C, the hue-value-correction-coefficient determining unit 602 determines a hue correction coefficient that converts the average hue value H*_ave of the object to H*_C. Meanwhile, the hue conversion is to be performed by using a known color conversion lookup table (LUT). The hue-value-correction-coefficient determining unit 602 determines a correction coefficient, by which the LUT converts RGB values to L*C*H* values, as the hue correction coefficient.

The hue correction coefficient can be obtained by determining a coefficient that converts H* of output signal values L*, C*, H* at each grid point in the LUT that converts RGB values to L*C*H* values to an output signal value, to which a hue correction amount ΔH has been added.

The hue correction amount ΔH for adjustment to H*_C described above can be obtained from the following equation.

$$\Delta H = H^*_C - H^*_\mathrm{ave}$$

Figure 10:
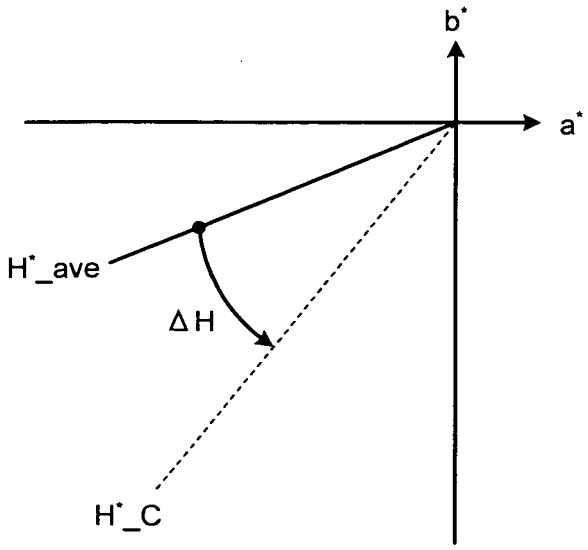
FIG. 10 is an explanatory diagram specifically illustrating how H*_ave on the a*b* plane in the L*a*b* color space is corrected (shifted) by ΔH to be adjusted to H*_C.

FIG. 10 is an explanatory diagram specifically illustrating how the hue-value-correction-coefficient determining unit 602 adjusts H*_ave on the a*b* plane in the L*a*b* color space to H*_C by correcting (shifting) H*_ave by ΔH.

Subsequently, at step S24, the color-conversion-coefficient setting unit 603 sets color conversion coefficients for a color conversion LUT (that converts RGB to CMYK), which is obtained by a composition of the hue correction coefficients for the color conversion LUT that converts RGB values to L*C*H* for hue adjustment and color conversion coefficients that convert L*C*H* to CMYK for coloring materials used in the printer. Then, the process sequence ends.

Meanwhile, the color conversion coefficients that convert L*C*H* to CMYK have been calculated by applying a method of least squares to relationship between measured input (L*C*H*) values and output (CMYK) values and have been stored in the parameter memory 303 in advance.

The color conversion LUT that converts RGB values to L*C*H* values is referred to as a first color conversion LUT; the color conversion LUT that converts L*C*H* values to CMYK values is referred to as a second color conversion LUT. As the color conversion coefficients for the color conversion LUT obtained by the composition of the first color conversion LUT and the second color conversion LUT, CMYK values obtained by inputting L*C*H* values, which are output values at each grid point in the first color conversion LUT, to the second color conversion LUT are used. The color-conversion-coefficient setting unit 603 sets, as output CMYK values, the CMYK values obtained at each grid point from the RGB values as above. The color conversion coefficients are provided for each object and used in the color conversions performed by the rendering unit 403.

Toner-Saving Process [3]

When hue correction (hue shifting) is performed in a toner-saving process, hues of a plurality of objects are corrected, by which color differences between objects become small. This can make the objects indistinguishable from each other and lead to degradation in print quality.

To overcome this, the toner-saving process [3] performs, if an image contains a plurality of objects, hue adjustment in a manner that a color difference between hue-adjusted objects is kept at a level equal to or larger than a predetermined value so as to prevent the hue-adjusted objects from having a same hue and becoming indistinguishable from each other.

As described above, average L*, C*, and H* values can be obtained from average R, G, and B values of an object. By hue adjustment, hue of an object is adjusted to any one of H*_C, H*_M, and H*_Y. Accordingly, color difference between objects is calculated on a hue-by-hue basis of the three hues.

Figure 11:
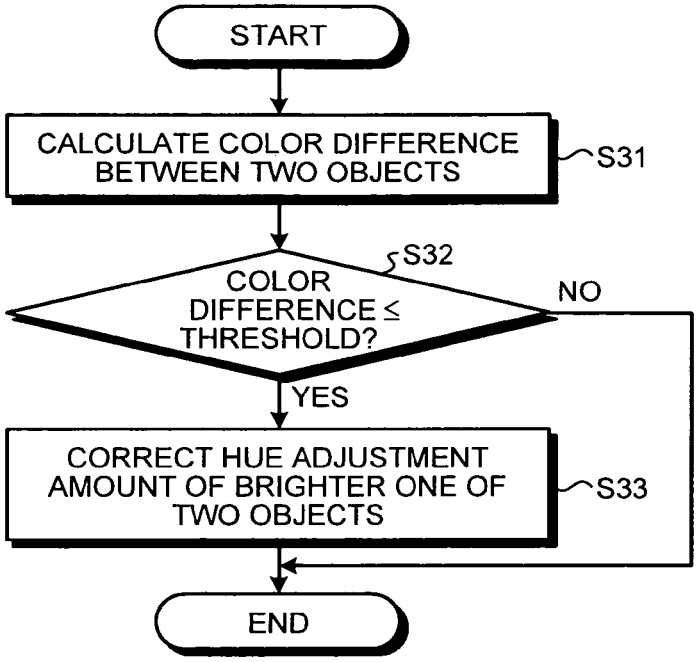
FIG. 11 is a flowchart illustrating a toner-saving process [3] that corrects a hue adjustment amount of an object.

FIG. 11 is a flowchart illustrating the toner-saving process [3] for correcting a hue adjustment amount for an object so as to keep a color difference at a level equal to or larger than a threshold value th_E. Processes described below is performed by the toner saving unit 404.

For simplicity, description is given with an example in which hue adjustment is performed on two objects obj1 and obj2 that belong to H*_C hue.

At step S31, the toner saving unit 404 calculates a color difference between the two objects based upon representative L* and C* values of the objects having undergone hue adjustment. The color difference ΔE_obj1,2 after the color adjustment is obtained from the following equation, where a symbol "^" denotes a power with an exponent that follows.

$$\Delta E_obj1,2=((L^*_obj1-L^*_obj2)\hat{}2+(C^*_obj1-C^*_obj2)\hat{}2)\hat{}½$$

At step S32, the toner saving unit 404 determines which one is larger between the obtained color difference and the threshold value. More specifically, the toner saving unit 404 compares ΔE_obj1,2 with the predetermined threshold value th_E, and if ΔE_obj1,2 is equal to or smaller than th_E (YES at step S32), the process sequence proceeds to step S33, where a hue adjustment amount of one of the objects is corrected. If ΔE_obj1,2 is larger than th_E (NO at step S32), the process sequence ends.

At step S33, after selecting the one object, of which hue adjustment amount is to be corrected, the toner saving unit 404 corrects the hue adjustment amount of the one object. An object that is larger in L* is selected as the one object, of which hue adjustment amount is to be corrected. This is because a toner consumption for the object that is larger in L* is smaller than that for an object that is smaller in L*, and therefore even when hue of the object with the larger L* is shifted from single-color hue to mixed-color hue, toner consumption can be reduced.

When the object to be subjected to hue correction is referred to as obj_hi, in a case where L*_obj1>L*_obj2, the relationship between obj_hi and obj1 can be expressed as follows.

$$obj_hi=obj1$$

In contrast, in a case where L*_obj1≤L*_obj2, the relationship can be expressed as follows.

$$obj_hi=obj2$$

The hue adjustment amount ΔH for obj_hi is changed to the following equation.

$$\Delta H=H^*_C-H^*_obj_hi-th_E$$

Upon completion of the processes described above, the process of correcting the hue adjustment amount is completed.

Correcting the hue adjustment amount in this way allows the level of the color difference between obj1 and obj2 to be kept at or larger than th_E.

The toner-saving process [3] has been described by using an example of the two objects. However, by similarly performing hue correction also for color differences of three or more objects, the toner-saving process can be performed while maintaining distinguishability of the objects.

Toner-Saving Process [4]

The toner-saving process [4] is an example that prevents, when hues of character objects are corrected, the hues from being converted to yellow (Y), thereby preventing the character objects from becoming indistinguishable.

For a drawing object of a character type, if a hue of the character object is closest to Y hue (H*_Y), the character is to be reproduced in yellow (Y). This makes it difficult to distinguish the character. To avoid this, determination is made as to whether or not a drawing object is a character object; if a drawing object is a character object, hue of the character object is not adjusted to yellow (Y) hue but converted to black.

Figure 12:
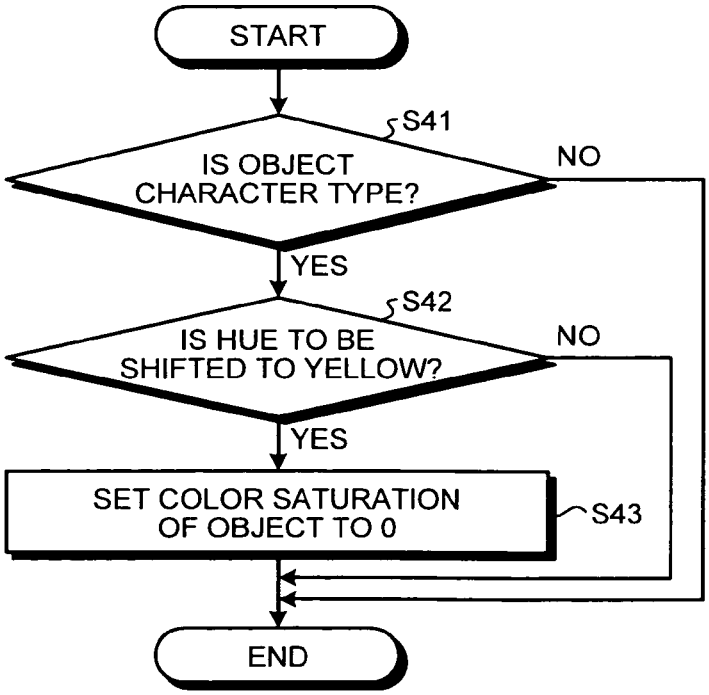
FIG. 12 is a flowchart illustrating a processing that converts hue of a character object to black.

FIG. 12 is a flowchart illustrating a process sequence of converting a character object to black. Processes described below are performed by the toner saving unit 404.

At step S41, the toner saving unit 404 determines whether an object is a character object based on an object type input from the drawing-screen managing unit 405. If the object is a character type (YES at step S41), the process proceeds to step S42. If the object is not the character type (NO at step S41), the process ends.

At step S42, the toner saving unit 404 determines whether or not hue of the character object is to be shifted to yellow hue. More specifically, when the character object is denoted as obj_char, the toner saving unit 404 obtains L*_obj_char, C*_obj_char, and H*_obj_char from a representative color of obj_char. Thereafter, the toner saving unit 404 determines whether or not H*_obj_char=H*_Yellow. If it is determined that H*_obj_char=H*_Yellow (YES at step S42), the process sequence proceeds to step S43. If it is determined that H*_obj_char≠H*_Yellow (NO at step S42), the process sequence ends.

At step S43, the toner saving unit 404 corrects the color saturation value of the character object. If hue closest to H*_obj_char is H*_Y, the toner saving unit 404 sets C*_obj_char to zero, and completes the process. Hence, when an object is a character object to be converted into yellow hue, a color saturation value of the object is corrected to zero; or, put another way, hue of the object is corrected to black monochrome.

Toner-Saving Process [5]

The toner-saving process [5] is an example for converting hue of an object of low brightness to black monochrome. If hue of a low-brightness drawing object is adjusted to single-color hue, the object is to be reproduced with black toner and single-color-hue toner. However, toner saving can be performed more efficiently when the object is reproduced only in black monochrome. Accordingly, toner-saving process [5] causes an object to be reproduced in black monochrome, depending on brightness of the object.

Figure 13:
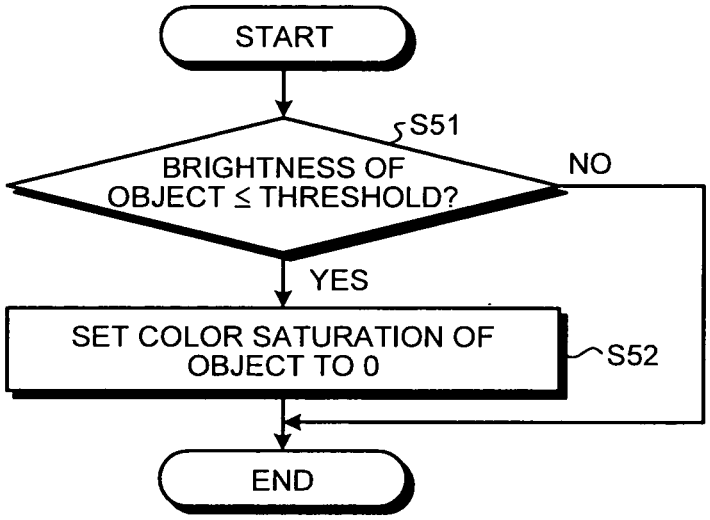
FIG. 13 a flowchart illustrating a toner-saving process [5] for causing an object to be reproduced in black monochrome depending on brightness of the object.

FIG. 13 a flowchart illustrating the toner-saving process [5] for causing an object to be reproduced in black monochrome, depending on brightness of the object, is performed. The process described below is performed by the toner saving unit 404.

At step S51, the toner saving unit 404 compares brightness of a representative color of an object with a threshold value th_L of brightness to determine whether the brightness of the representative color is equal to or smaller than th_L. If it is determined that the brightness is equal to or smaller than th_L (YES at step S51), the process proceeds to step S52. By contrast, if it is determined that the brightness is larger than th_L (NO at step S42), the process sequence ends.

At step S52, the toner saving unit 404 corrects color saturation C*_obj of the object to zero. Then, the process sequence ends. Thus, the toner saving unit 404 corrects the color saturation value of the object to zero, causing the object to be reproduced in black monochrome.

Toner Saving Process [6]

The toner saving process [6] is another example of a toner saving process, for which a print preview is automatically provided. The toner saving process that yields an output whose print quality is not easily presumed by a user is not limited to those described above. Other examples of such a toner saving process include a technique of reducing an amount of toner to be used by extracting edges of a character and printing an inside portion of the character with a toner density lower than a toner density at outlines.

Figure 14:
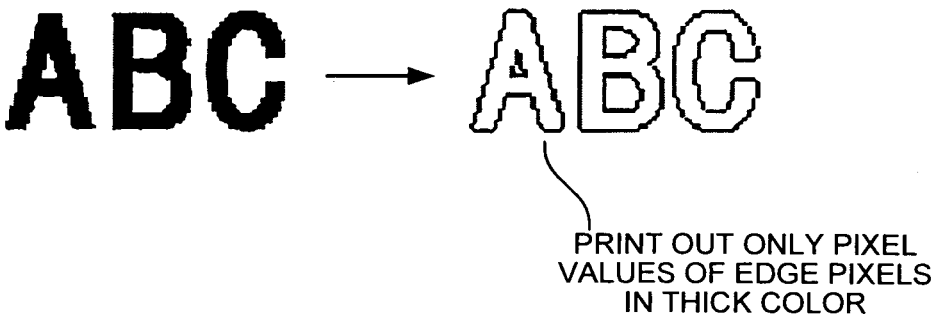
FIG. 14 is an explanatory diagram illustrating a specific example of a toner-saving process according to a toner-saving processing [6].

FIG. 14 is an explanatory diagram illustrating a specific example of a toner saving process according to the toner saving process [6]. The toner saving unit 404 extracts edge portions of a target object (in the example illustrated in FIG. 14, the characters "ABC") and converts color pixel values such that only the edge portions of the character portion are reproduced in a thick color (but inside portions of the characters are reproduced in a light color). This allows reduction in toner consumption to be achieved while maintaining legibility because the edge portions are distinguishable.

Similar to this example, in a process in which toner saving is achieved by changing shapes of objects, a print preview may be automatically provided to prompt a user to check a print quality as already described above in other examples.

It is assumed that computer programs to be executed in the present embodiment are provided in a form of being preinstalled in the ROM 202 and the system memory 302 in advance; however, means to provide the computer programs is not limited to these. For example, the computer programs to be executed in the present embodiment can be provided in a form of being recorded in a computer-readable recording medium such as a compact disk read-only memory (CD-ROM), a flexible disk (FD), a CD recordable (CD-R), or a digital versatile disk (DVD) in an installable or executable format.

The computer programs to be executed in the present embodiment can be configured to be stored in a computer connected to a network, such as the Internet, so that the programs are provided by downloading via the network. Also, the computer programs to be executed in the present embodiment can be configured to be provided or distributed over a network, such as the Internet.

The programs to be executed in the present embodiment have a module configuration that includes the units described above (the selecting unit 11, the printing-selection prompting unit 12, the determining unit 21, the toner saving unit 404, and the print output unit 22). From the viewpoint of actual hardware, the image processing programs are loaded, by the CPU (processor), from the storage medium and executes the programs to generate the units on a main memory device, such as the RAM, thereby generating the selecting unit 11, the printing-selection prompting unit 12, the determining unit 21, the toner saving unit 404, and the print output unit 22 on the main memory device.

According to an aspect of the present invention, for a toner-saving process that yields an output whose print quality is easily presumed by a user, a printed output is produced without providing a print preview, whereas for a toner-saving process that yields an output whose print quality is not easily presumed by a user, a print preview is automatically provided, thereby causing a user to check the print quality. Accordingly, the necessity of producing a printout again, which may otherwise arise as in a conventional toner-saving process because of disparity between a print quality of an actual printout and an expected print quality, can be eliminated. Hence, there is yielded an effect that an image can be formed in a toner-saving process efficiently.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image processing apparatus capable of performing a plurality of toner-saving processes each reducing an amount of toner consumed to form an image, the image processing apparatus comprising:

a selecting unit that allows a user to select one toner saving process from the plurality of toner saving processes;

a toner saving unit that performs the one toner saving process selected through the selecting unit; and a display unit that provides, when the one toner saving process is a predetermined toner saving process that yields a printed output whose print quality is not easily presumed by the user, a preview display representing the print quality of the printed output to be yielded by the one toner saving process, wherein the toner saving unit performs, as the toner saving process that yields a printed output whose print quality is not easily presumed by the user, a process of changing hue of an input image, and the toner saving unit performs the process of changing the hue by changing the hue depending on hue of an object in the input image.

2. The image processing apparatus according to claim 1, further comprising a printing-selection prompting unit that prompts the user to determine whether printing onto a recording sheet is to be performed in the print quality represented by the preview display.

3. The image processing apparatus according to claim 1, wherein the toner saving unit performs the process of changing the hue by correcting a hue changing amount depending on hue and brightness of an object in the input image.

4. The image processing apparatus according to claim 1, wherein the toner saving unit performs the process of changing the hue by adjusting color saturation depending on a type of an object in the input image.

5. The image processing apparatus according to claim 1, wherein the toner saving unit performs, as the toner saving process that yields a printed output whose print quality is not easily presumed by the user, a process that prints out a character image such that a toner density of the character image is lower in an inside portion than at an outline portion.

6. An image processing method including a plurality of toner saving processes each reducing an amount of toner consumed to form an image, the image processing method comprising:

allowing a user to select one toner saving process from the plurality of toner performing the one toner saving process selected at the selecting; and providing, when the one toner saving process is a predetermined toner saving process that yields a printed output whose print quality is not easily presumed by the user, a preview display representing the print quality of the printed output to be yielded by the one toner saving process, performing, as the toner saving process that yields a printed output whose print quality is not easily presumed by the user, a process of changing hue of an input image, and performing the process of changing the hue by changing the hue depending on hue of an object in the input image.

7. A computer program product comprising a non-transitory computer-readable medium having computer-readable program codes recorded in the medium, the program codes when executed causing a computer to execute:

an image processing including a plurality of toner saving processes each reducing an amount of toner consumed to form an image, the image processing comprising:

allowing a user to select one toner saving process from the plurality of toner saving processes;

performing the one toner saving process selected at the selecting; and providing, when the one toner saving process is a predetermined toner saving process that yields a printed output whose print quality is not easily presumed by the user, a preview display representing the print quality of the printed output to be yielded by the one toner saving process, performing, as the toner saving process that yields a printed output whose print quality is not easily presumed by the user, a process of changing hue of an input image, and performing the process of changing the hue by changing the hue depending on hue of an object in the input image.

* * * * *